US009316049B2

(12) United States Patent
Rupel et al.

(10) Patent No.: US 9,316,049 B2
(45) Date of Patent: Apr. 19, 2016

(54) COLLAPSIBLE CELLULAR SHADE ASSEMBLY AND METHOD FOR CONSTRUCTING SAME

(75) Inventors: John D. Rupel, Pine River, WI (US); Scott R. Cheslock, Pulaski, WI (US)

(73) Assignee: Hunter Douglas, Inc., Pearl River, NY (US)

( * ) Notice: Subject to any disclaimer, the term of this patent is extended or adjusted under 35 U.S.C. 154(b) by 459 days.

(21) Appl. No.: 13/409,731

(22) Filed: Mar. 1, 2012

(65) Prior Publication Data

US 2013/0228290 A1 Sep. 5, 2013

(51) Int. Cl.

| | |
|---|---|
| ***A47H 5/00*** | (2006.01) |
| ***E06B 3/38*** | (2006.01) |
| ***E06B 3/94*** | (2006.01) |
| ***E06B 9/06*** | (2006.01) |
| ***E06B 9/262*** | (2006.01) |
| *E06B 9/386* | (2006.01) |

(52) U.S. Cl.
CPC ..... *E06B 9/262* (2013.01); *E06B 9/386* (2013.01); *E06B 2009/2627* (2013.01)

(58) Field of Classification Search
CPC ..... E06B 9/262; E06B 2009/2627
USPC ..... 160/84.01, 84.04, 84.05; 428/116
See application file for complete search history.

(56) References Cited

U.S. PATENT DOCUMENTS

| | | | | |
|---|---|---|---|---|
| 2,201,356 | A | | 5/1940 | Terrell |
| 4,388,354 | A | | 6/1983 | Suominen |
| 4,603,072 | A | | 7/1986 | Colson |
| 4,677,012 | A | | 6/1987 | Anderson |
| 4,677,013 | A | | 6/1987 | Anderson |
| 4,685,986 | A | | 8/1987 | Anderson |
| 4,732,630 | A | | 3/1988 | Schnebly |
| 4,861,404 | A | | 8/1989 | Neff |
| 4,974,656 | A | | 12/1990 | Judkins |
| 5,090,098 | A | | 2/1992 | Seveil et al. |
| 5,158,632 | A | * | 10/1992 | Colson et al. ..... 156/197 |
| 5,205,333 | A | * | 4/1993 | Judkins ..... 160/84.02 |
| 5,228,936 | A | | 7/1993 | Goodhue |
| 5,339,882 | A | | 8/1994 | Judkins |
| 5,691,031 | A | | 11/1997 | Swiszcz et al. |
| 5,701,940 | A | * | 12/1997 | Ford et al. ..... 160/84.05 |
| 5,746,266 | A | * | 5/1998 | Colson et al. ..... 160/84.05 |
| 5,753,338 | A | | 5/1998 | Jelic et al. |
| 6,033,504 | A | | 3/2000 | Judkins |
| 6,068,039 | A | | 5/2000 | Judkins |

(Continued)

FOREIGN PATENT DOCUMENTS

| | | | |
|---|---|---|---|
| EP | 0482794 | A1 | 10/1991 |
| WO | WO2004/106048 | A2 | 12/2004 |

*Primary Examiner* — Syed A Islam
*Assistant Examiner* — Jeremy Ramsey
(74) *Attorney, Agent, or Firm* — Dority & Manning, PA

(57) ABSTRACT

An expandable and contractable shade assembly includes a plurality of closed D-shaped cell structures aligned vertically one above another with juncture lines defined between adjacent structures. Each closed cell structure includes a front face and a separate back face that are attached to one another at top and bottom tabs. The front face of one cell structure is attached but non-continuous to the front face of an adjacent cell structure. Accordingly the horizontal width of the shade assembly is not limited by the width of the materials forming the individual cell structures. Upon collapse, the back face folds toward the front of the shade such that the back face and the front face are nested within one another, leading to a narrow depth profile for the collapsed shade.

14 Claims, 7 Drawing Sheets

(56) References Cited

U.S. PATENT DOCUMENTS

| | | | | |
|---|---|---|---|---|
| 6,491,084 | B2 * | 12/2002 | Voss et al. | 160/84.05 |
| 6,767,615 | B1 | 7/2004 | Judkins et al. | |
| 7,111,659 | B2 | 9/2006 | Harper et al. | |
| 7,159,634 | B1 * | 1/2007 | Judkins | 160/84.05 |
| 7,588,068 | B2 | 9/2009 | Colson et al. | |
| 7,833,368 | B2 | 11/2010 | Judkins et al. | |
| 8,220,518 | B2 * | 7/2012 | Judkins | 160/84.05 |
| 2008/0149279 | A1 * | 6/2008 | Leighty et al. | 160/10 |
| 2008/0222786 | A1 * | 9/2008 | Zell et al. | 4/499 |
| 2008/0251216 | A1 * | 10/2008 | Hsu | 160/84.01 |
| 2010/0059186 | A1 * | 3/2010 | Colson et al. | 160/84.01 |
| 2011/0088851 | A1 | 4/2011 | Judkins | |

* cited by examiner

COLLAPSIBLE CELLULAR SHADE ASSEMBLY AND METHOD FOR CONSTRUCTING SAME

BACKGROUND

Cellular shades are a popular type of window covering in residential and commercial applications. The shades are aesthetically attractive and also provide improved insulation across a window or other type of opening due to their cellular construction. Cellular shades have assumed various forms including a plurality of longitudinally extending cells, generally of a "D" or "honeycomb" shape, made of a flexible, semi-rigid, or rigid material. Cellular shades can be mounted at the top of a door or window for extending across an architectural opening. When the shade is in an expanded state, the open cells cover the opening. The shade can be retracted or drawn into a contracted state wherein the cells collapse and are gathered together. When viewed from the front (i.e., interior of a room) this stack may have an appearance similar to stacked slats of a Venetian blind. Typically, the front and back of each cell collapse outwardly, e.g., toward the room side and the window side of the shade, respectively, and the controlling cords are normally disposed through the connecting point between each cell. Such cellular shades can have a very wide profile when contracted, due to the extension of the front and back of the individual cells in opposite directions during collapse, and can require a fairly deep mounting space in an architectural opening.

In the past, individual cells in a cellular shade have been constructed using various techniques and methods. Various methods for construction of cellular shades have been described, for instance, in U.S. Pat. Nos. 7,833,368, 7,588,068, 7,159,634, 7,111,659, 6,767,615; 6,068,039; 6,033,504; 5,753,338; 5,701,940; 5,691,031; 5,339,882; 5,228,936; 5,205,333; 4,974,656; 4,861,404; 4,732,630; 4,685,986; 4,677,012; 4,603,072; 4,388,354; and 2,201,356.

For example, cellular shades have been produced from two sheets of material which are pleated and then glued at the apex of the folds to form the cells. Alternatively, cellular shades have been produced by joining together multiple flat sheets of material along alternating glue lines between each flat sheet. Cellular shades have also been produced by attaching a series of slats between two spaced apart sheets of material.

In the past, one problem faced by manufacturers is the ability to produce cellular shades having a variable width. For example, as described above, in the past, two materials were joined together to produce the cellular shade. Consequently, the width of the shades was limited by the width of the roll of material. Thus, what is needed is a method of manufacturing cellular shades in which the cellular shades can have any desired width and are in no way limited by the width of the material used to form the shades. In this manner, cellular shades may be produced that can fit any architectural opening regardless of the width of the architectural opening. In addition, custom made shades may be produced that are designed to fit a particular space.

Additionally, cellular shades that can be collapsed with a small depth profile, so as to provide a low profile shade when contracted, would be of great benefit in the art.

The present disclosure is directed to improvements in cellular shades. More particularly, the present disclosure is directed to an improved cell structure and method for constructing a cellular shade.

SUMMARY

The present disclosure is directed to a cellular shade comprised of a plurality of closed cell structures. As will be described in greater detail below, each closed cell structures is made from separate pieces of forming material(s) allowing for the cell structures to include a face fabric that is different from a back fabric and allowing for the horizontal direction of the shade to be of any desired width. For instance, each cell can be formed to any desired horizontal dimension, independent of the forming material's weft dimension. In accordance with the present disclosure, the front face and the back face of a single cell are formed of individual pieces of material and are attached to each other and to an adjacent cell at the top and bottom of the cell. An upper tab and a lower tab may be formed where the front face and back face materials are joined. A plurality of individual cells can be attached to one another at the tabs to form a juncture and a plurality of longitudinally attached cells can form a shade of any desired length and width. The front face piece is longer from the top of the cell to the bottom of the cell than the back piece. Accordingly, the cell will have a "D" configuration when the cell is open.

In one embodiment, a cellular shade can include a plurality of sequential and interconnected closed cell structures attached to one another and extending in a longitudinal direction. The cell structures have a collapsed position when the shade is contracted and have an open position when the shade is extended. The cell structures include a front face and a separate back face. The cell structures are constructed such that the front face and the back face collapse in the same direction to form a nested collapsed cell structure. The back face material can be a light weight material and can collapse within the front face without causing any indentation or formation of pressure marks or lines on the front face. In one particular embodiment, for instance, the back face can be made from a shear material that allows light to pass through the material and illuminate the front face when the shade is exposed to sunlight. For instance, the back fabric can be formed of a material that is light weight and relatively sheer, allowing more light to pass through the back fabric, while the face fabric can be made from a material that allows less light to pass through the material in comparison to the back fabric or may substantially block light from passing through the material. In one particular embodiment, for instance, the material forming the front face of the cellular structures may have weight at least twice that of the material forming the back face. For instance, the back face can have a weight of less than about 3 ounces per square yard. In another embodiment, a light weight fabric forming the back face can transmit light through the face. Adjusting the opacity and/or the transmittance of the face fabric and the back fabric can not only provide for the nesting of the front and back fabrics upon contractions without formation of indentations upon the face fabric, but can also produce a shade product that illuminates a room in a desired way.

The cellular shade can further include a lift system that is configured for vertically drawing the closed cell structures from a fully expanded configuration into a fully contracted configuration. The lift system, for instance, may include a plurality of lift cords that are connected to the closed cell structures. The cellular shade can further include a head rail assembly for mounting the shade into an architectural opening. The head rail assembly may also be in operative association with the lift system for contracting and extending the cellular shade.

One of the advantages of shades of the present disclosure is the ability to produce closed cell structures in which the width of the cells is not limited. In one embodiment, for instance, a shade may be greater than 110 inches in width, or greater than 180 inches in another embodiment.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
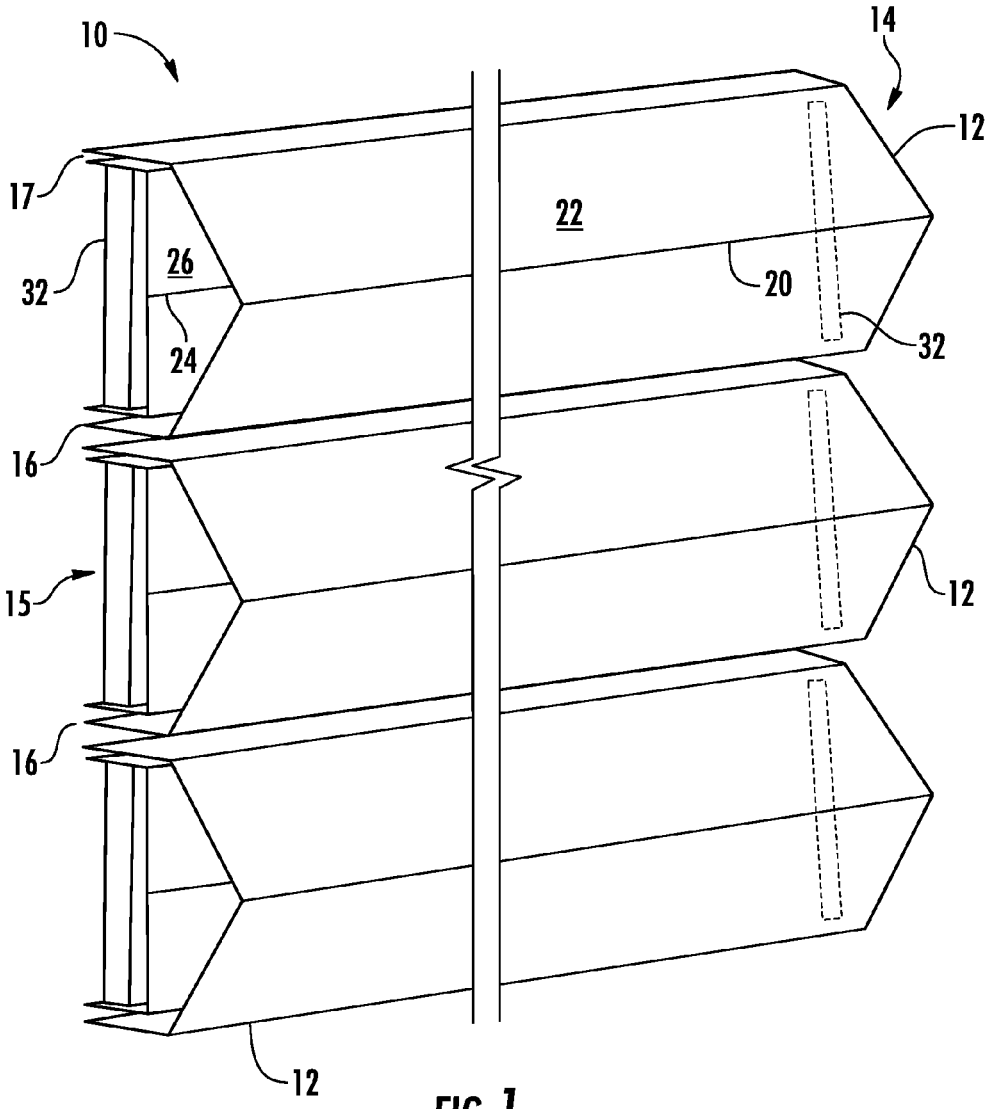
FIG. 1 is a partial perspective view of one embodiment of a cellular shade assembly made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to cellular shade assemblies that can be mounted in an architectural opening, such as a window or door, for blocking light, providing privacy, increasing the aesthetic appeal of a room and/or allowing a desired amount of light into a room.

The closed cell structures of the present disclosure offer various advantages and benefits. For example, the closed cell structures are made from multiple pieces of material that allow for different materials to be combined together in producing each cell structure. The different materials can be combined for increasing the overall aesthetic appeal of the product and/or for adjusting the amount of light that passes through the shade assembly.

In addition, each of the cell structures of the present disclosure can be formed of two or more pieces of material that together form the face and back of only a single cell. Multiple individual cell structures can be attached to one another to form a single shade. Accordingly, a shade can be formed to any desired length and width, and in one particular embodiment, a shade can be wider than the weft length of available woven materials.

The material forming the face of a cell can have a greater longitudinal dimension than the material forming the back of a cell, such that the cell can have a "D" shaped configuration upon expansion. Upon contraction each cell can have a nested configuration. Accordingly, a shade can define a narrow depth profile upon contraction with backing material nested within the facing material of each cell. The backing material can also be a relatively light weight material as compared to the facing material, such that the nested configuration of the shade does not lead to formation of pressure marks, e.g., indentations or lines, upon the facing fabric.

Figure 2:
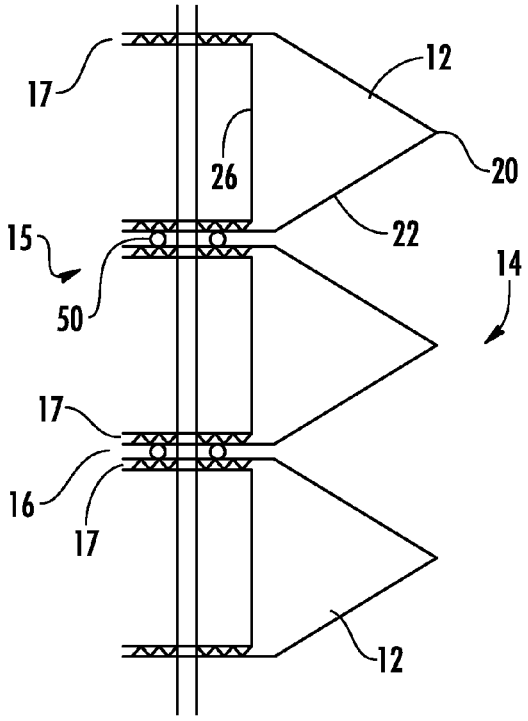
FIG. 2 is an exploded side view of the cellular structures illustrated in FIG. 1.
Figure 3:
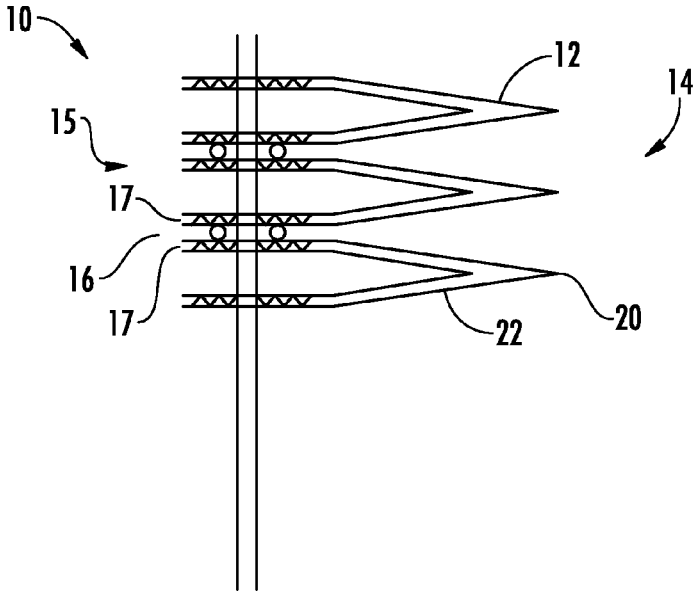
FIG. 3 is another side view of the cellular structures illustrated in FIG. 1 shown in a contracted position.

Referring to FIGS. 1 through 3, one embodiment of an expandable and contractable shade assembly 10 made in accordance with the present disclosure is shown. In FIG. 1, a portion of the shade assembly is shown, which can be mounted within a window similar to the embodiment illustrated in FIG. 6. It should be readily appreciated, however, that the shade assembly 10 is not limited in its particular use as a window or door shade, and may be used in any application as a covering, partition, shade, or the like in any type of architectural opening in a building or structure.

As shown in FIGS. 1 through 3, the shade assembly 10 includes a plurality of closed cell structures 12 that are disposed longitudinally along a width dimension of the shade assembly so as to extend across a window or other opening. The closed cell structures 12 are aligned vertically one above another with junctures 16 defined between adjacent cell structures 12. The shade assembly 10 generally includes a front 14 that is intended to face the interior of a room or building and a back 15 that is intended to face a window or the outside environment.

As depicted in the various figures, each of the cell structures 12 is "closed" in that the structure is defined by a continuous, unbroken circumferential wall. The cell structures 12 are formed from a facing material or fabric that may be flexible or semi-rigid. As will be described in greater detail below, the cell structures 12 can be made different types of materials or fabrics depending upon the particular application. A "flexible" material is a generally pliant material that is capable of being folded or flexed, and includes such materials as woven, knitted, or non-woven fabrics, vinyl or film sheets, cords of natural or synthetic fibers, monofilaments, and the like. A "semi-rigid" material is somewhat stiffer, but is still flexible or foldable to some degree. Examples of such materials include resin reinforced fabrics, polyvinyl chloride, and so forth. It should be readily appreciated that the present disclosure is not limited to the type of material used to form the cell structures.

Figure 8:
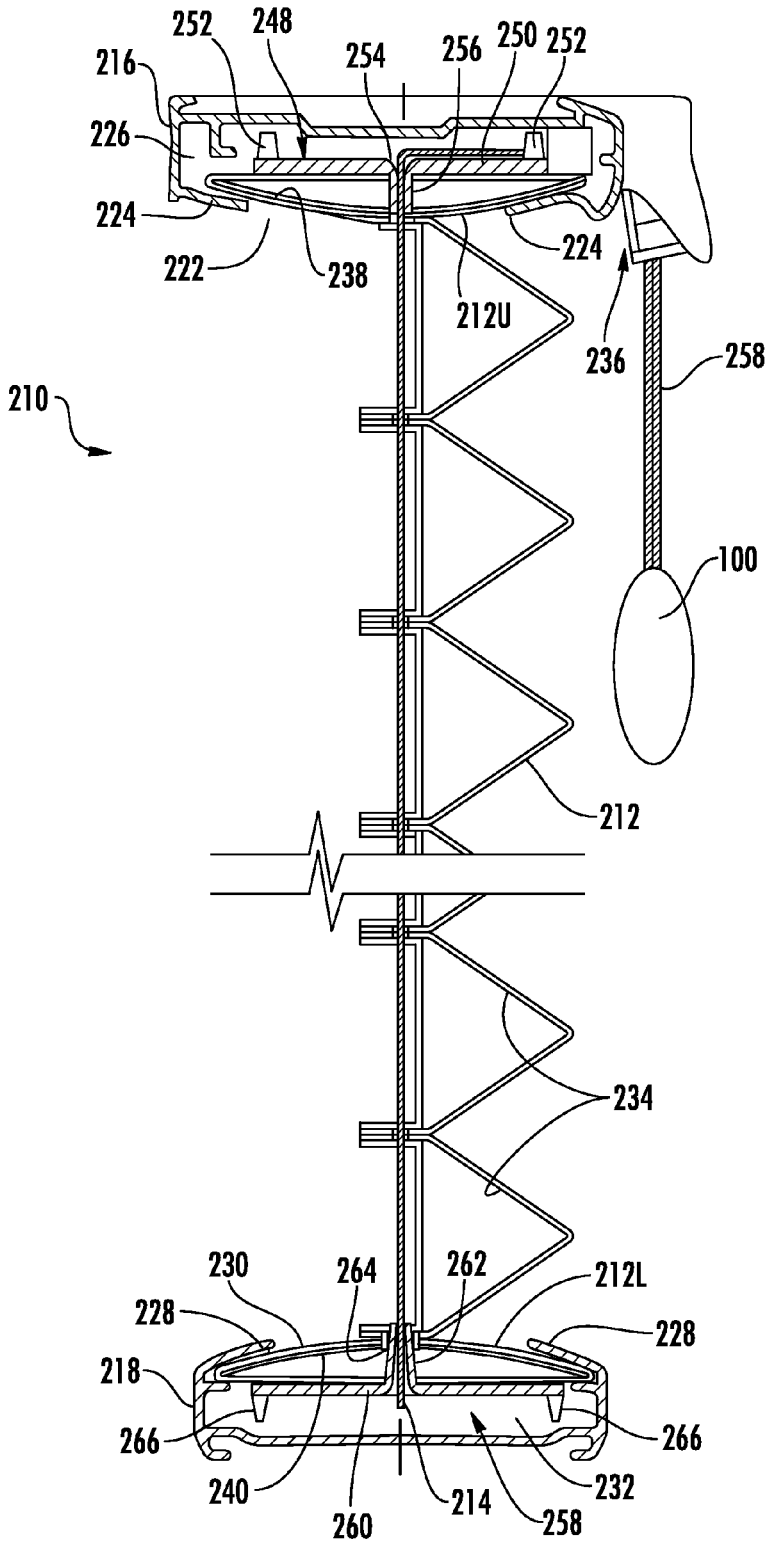
FIG. 8 is a side view of an embodiment of a cellular shade assembly including a base and head rail.

Similar to the embodiment illustrated in FIG. 8, the shade assembly 10 shown in FIG. 1 can include a head rail that is adapted to be mounted to the frame structure of a window, door or other type of opening. The head rail may include an extruded longitudinally extending component that includes any number of chambers, channels or other features necessary for incorporating a lift system, cords, pulleys and the like, for raising and lowering the shade assembly 10 between a fully expanded configuration as illustrated in FIGS. 1 and 2 and a fully contracted configuration as illustrated in FIG. 3.

The closed cell structures 12 generally have a D-like shape. As shown in FIG. 1, for instance, each cell structure 12 includes a first fold line 20 located along a front face 22 and an opposing second fold line 24 located along a back face 26. The fold line 20 results in a three-dimensional expansion of the front face 22 resulting in the D-like shape. The fold line 24 provides direction for the back face 26 during contraction to encourage the back face to fold and become nested within the folded front face 22. The longitudinal dimension of the back face 26 is less than the longitudinal dimension of the front face 22 and upon expansion the back face 26 will have an essentially flat, vertical profile providing the back of the D-like shape of the cell structures 12.

As shown in FIG. 3, the first fold line 20 along the front face 22 and the second fold line 24 along the back face 26 cause the cell structures 12 to close when the shade assembly is contracted such that the front face 22 and the back face 26 both collapse along the fold lines in a direction toward the front of the shade, causing the back face 26 to become nested within the front face.

In order to avoid the formation of any pressure marks or lines on the front face 22 of the shade due to the nested contraction of the shade, the material utilized for the back face 26 of the shade can be a relatively light weight material. For instance, as shown in FIGS. 1-3, the front face 22 and the back face 26 of each closed cell structure is made from a separate piece of material. In general, the front face 22 and the back face 26 can be made from different materials and the material that forms the back face can be of a lighter weight than the material that forms the front face. For instance, the material that forms the front face 22 can have a weight that is at least twice the weight of the material that forms the back face. For example, the light weight material that forms the back face can be less than about 3 oz. per square yard, less than about 2 oz. per square yard, or less than about 1 oz. per square yard.

In one embodiment, the front face 22 can be made from a material that does not permit significant amounts of light to pass through the material, while the back face 26 can be made from a light weight material that allows much larger quantities of light to pass through the material. In this manner, the front face 22 may appear to illuminate when the shade assembly is in an extended position and light, such as sunlight, is striking the shade from the back side. In the above embodiment, for example, the back face 26 may be made from a fabric having a relatively open weave, such as a shear material made from monofilaments or may comprise a film. The front face 22, on the other hand, may comprise a woven fabric, a knitted fabric, or a non-woven fabric such as a hydroentangled web.

When combining together different fabrics with different weight and different light transmittance, the back face can have a light transmittance at a wavelength of 500 nanometers that is at least 50% greater than a transmittance of the front face at 500 nanometers. For instance, the back face can have a light transmittance at a wavelength of 500 nanometers of at least about 20%, such as at least about 30%, such as at least about 40%, such as at least about 50%, such as at least about 60%, such as even greater than about 70%. Light transmittance of a fabric can be tested using a spectrophotometer, such as a JASCO V-570 UV/VIS/NIR spectrophotometer. One procedure for measuring the percent transmittance of a material is described, for instance, in U.S. Pat. No. 7,481,076, which is incorporated herein by reference.

Another way to compare the front face material with the back face material is to measure opacity. Opacity can be measured using a Hunter Color Difference Meter and can range from 0 to 100%. In one embodiment, the opacity of the back face material may be at least 20% less, such as at least 30% less, such as at least 40% less, such as at least 50% less, such as at least 60% less than the front face material or vice versus.

In order to adjust the shade assembly between an extended position and a collapsed position, the shade assembly can include a lift system. Various cord-type lift systems are well known in the art, and any one of these types of systems may be configured or utilized for use with the shade assembly 10. As shown particularly in FIG. 1, the lift system includes a plurality of lift cords 32. The lift cords 32 are disposed in a vertical line of action intersecting each closed cell structure 12. In particular, the lift cords 32 extend through the closed cell structures 12 from the top of each cell structure to the bottom of each cell structure and pass through the junctures 16 where a front face 22 and a back face 26 are joined to one another and where a two adjacent cell structures 12 are joined to one another.

The lift cords 32 may vary in number depending upon the width of the shade assembly 10. For example, at least two lift cords can be spaced over the width of the shade assembly, such as from about two lift cords to about six lift cords.

In the embodiment illustrated in FIGS. 1 through 3, the cell structures 12 collapse into a horizontal stack when the assembly is in a fully contracted configuration as shown in FIG. 3. In particular, the stack of cell structures 12 are horizontally oriented in that the first fold lines 20 and the second fold lines 24 extend horizontally toward the front 14 of the shade assembly 10 to provide the nesting arrangement that leads to a narrower depth profile for the shade upon contraction. As the shade collapses with extension only in the forward direction, i.e., both the front and back face of the shade collapse in a direction toward the front face of the shade, the shade can utilize a smaller mounting clearance as compared to previously known shades. For instance, the shade be mounted more closely to a window with the mounting brackets extending to a lesser distance out into a room as compared to collapsible cell structure shades in which the back face collapses in a direction toward the back of the shade, e.g., toward the window.

Referring now to FIG. 2, the manner in which the closed cell structures 12 are constructed is shown in greater detail. As illustrated, the front face 22 and the back face 26 of each cell 12 are attached to one another to form tabs 17. More specifically, each front face 22 is a not a part of a continuous piece of material that is merely folded upon itself to form the front face of the next adjacent cell 12. Thus, at a juncture 16 a tab 17 formed of a terminus of a front face 22 and a terminus of a back face 26 at the bottom of one cell structure 12 is joined to a tab 17 at the top of a second cell structure, with the front face of the first cell structure directly joined to the front face of the second cell structure at the juncture 12. Because the front face 22 and the back face 26 of an individual cell structure 12 are attached but non-continuous (i.e., not formed of a single, folded piece of material), the horizontal width of the cell structure is not limited to the horizontal wide, e.g., the weft, of the material that forms either the front face 22 or the back face 26. For example, the horizontal width of a cell structure can be cut along the warp direction of the materials that form the front face 22 and the back face 26 of the cell structure 12. This allows for an unlimited width dimension of a formed shade. In the past, the width dimension of a shade was limited to the width of the forming material, e.g., the weft direction or bolt width of the forming material. This problem has been overcome in disclosed shades, as each cell structure of a shade can be formed individually and as such to any desired length. For example, the horizontal dimension of a shade as disclosed herein can be greater than 100 inches, greater than 110 inches, greater than 150 inches, or greater than 180 inches, with no vertical joinings, e.g., seams, necessary along the width of either the front face or the back face. In other embodiments, for instance, the horizontal dimension of the shade can be greater than about 220 inches, such as greater than about 250 inches, such as greater than about 300 inches, such as greater than about 350 inches, such as greater than about 400 inches, such as greater than about 450 inches, such as greater than about 500 inches, such as greater than about 550 inches, such as even greater than about 600 inches. The horizontal dimension of a shade made in accordance with the present disclosure is really not limited in any way. For some applications, however, the horizontal dimension of the shade may be fess than about 600 inches, such as less than about 500 inches, such as less than about 400 inches.

As shown in FIG. 2, a front face 22 and a back face 26 of a single cell structure 12 can be joined to one another to form a tab 17. The manner of joining the two materials at tab 17 is not critical to disclosed shades. For instance a bead of adhesive, melt bonding, sonic welding, stitching, or any other suitable bonding method may be incorporated in joining a front face 22 to a back face 26 at both the top and bottom tabs 17 of a cell structure 12.

As shown in FIG. 2, adjacent cell structures 12 are attached to each other at juncture 16 along attachment points 50. Each attachment point 50 may comprise, for instance, a bead of adhesive or any other suitable attachment structure, such as stitches, melt bonding, sonic welding, and so forth. In addition, the manner of attachment between the front face 22 and the back face 26 of a single cell structure and the manner of attachment between two adjacent cell structures can be the same or different and may be carried out sequentially or in a single attachment step. For instance, individual cell structures 12 may first be formed including tabs 17 at the top and bottom of each cell structure, and then a plurality of formed cell structures may be attached to one another at junctures 16 to form a shade of the desired length. Moreover, the attachments between faces and cell structures may be along a single attachment point that extends the entire width of the tab and/or juncture. As shown, the front face 22 of a cell structure is attached to both the back face 26 of that cell structure as well as to the front face of an adjacent cell structure. In addition to advantages discussed previously, this attachment configuration can provide a plurality of sequential connected closed cell structures that have excellent strength properties at the junctures 16 where the cells are connected.

The juncture 16 attachment points 50 and tab attachment points 17 as shown in FIG. 2 not only connect the cellular structures together, but also assist in providing the overall shape of the cells. The attachment points, for instance, assist in creating the D-like shape of the cell structures without having to create further fold lines in the front face 22 or the back face 26. In this regard, the shape of the cell structures 12 can be modified by increasing or decreasing the width of the attachment points between adjacent cell structures.

Figure 4A:
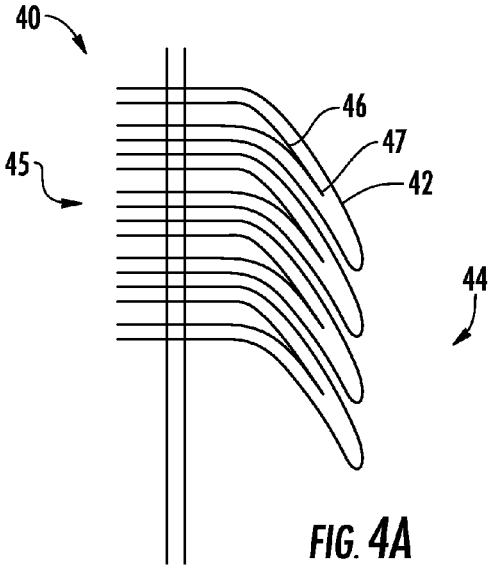
FIG. 4 is a side view of another embodiment of a cellular shade assembly shown in a contracted position.
Figure 4B:
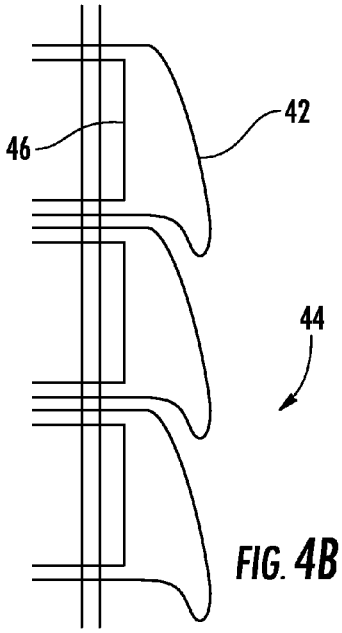

In the embodiment illustrated in FIG. 3, upon contraction, the individual cells can remain substantially horizontal. Thus, the material used to form the front face 22 of the illustrated shade 10 can be semi-rigid, so as to hold the contracted cell structures 12 in a fairly rigid horizontal position when the shade 10 is contracted. Referring now to FIG. 4, another embodiment of a cellular shade assembly 40 generally made in accordance with the present disclosure is shown. Similar to the embodiment illustrated in FIG. 3, the closed cell structure 42 includes a front face 43 that is separate from a back face 46. In the embodiment illustrated in FIGS. 1-3, the front face 22 defines a fold line 20. In this alternative embodiment, however, the front face does not include a fold line. Instead, the front face may billow outwardly from the back face and may have a drooping aspect as well, as illustrated in a contracted position in FIG. 4A and in an extended position in FIG. 4B. The drooping and/or billowing profile may be desired in some applications for providing a unique and aesthetically pleasing appearance.

In the embodiment of FIG. 4, the front face 43 does not define a fold line, but the back face 46 defines a fold line 47 that separates the back face into an upper and lower segment when the back face 46 is collapsed. Similar to the embodiment illustrated in FIG. 3, the back face 46 is nested in the front face 43 upon collapse of the shade 40. Instead of a relatively stiff and rigid, horizontal formation of the collapsed cells, however, in the embodiment of FIG. 4 the material forming the front face 43 is more supple and pliable. Hence, the cell structures 42 can fold and hang in a more billowing fashion at the front 44 of the shade 40. Accordingly, through selection of the basis weights of the materials used in forming the shades, a variety of different aesthetically pleasing presentations can be prepared.

Figure 5:
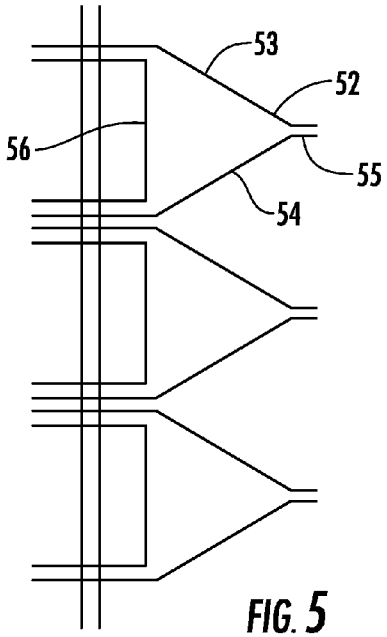
FIG. 5 is a side view of another embodiment of a cellular shade assembly shown in an extended position.

In the embodiment illustrated in FIG. 5, the front face 52 is separated into two separate pieces of material. In particular, a first segment 53 is made from a separate piece of material than the second segment 54. The first segment 53 is attached to the second segment 54 at bond points forming a tab 55. It should be understood that the tab 55 can also be formed along the front face 52 without having to use two separate pieces of material. In general, the back face 56 will not be formed of separate pieces of material and will not include a tab, as this could lead to the formation of indentations or marks on the material used to form the front face of the shade.

Similar to the embodiments illustrated in FIGS. 1-4, the cell structure illustrated in FIG. 5 can also be made from different materials. In particular, the front face 52 can be made from a heavier material than the back face 56 as described above. In addition, the first segment 53 of the front face 52 can also be made from a different material than the second segment 54 of the front face 52.

Figure 6:
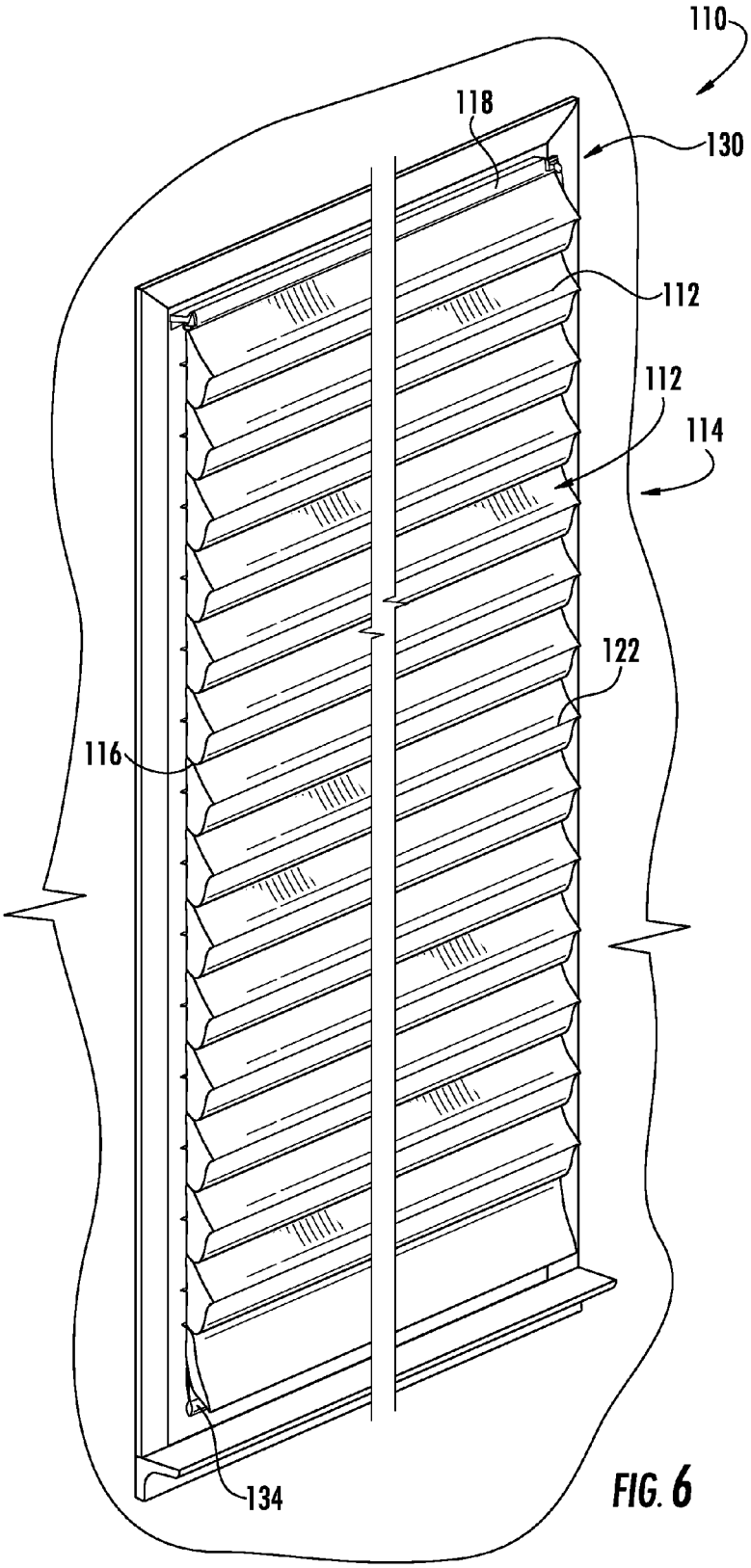
FIG. 6 is a perspective view of an embodiment of a cellular shade assembly made in accordance with the present disclosure.
Figure 7:
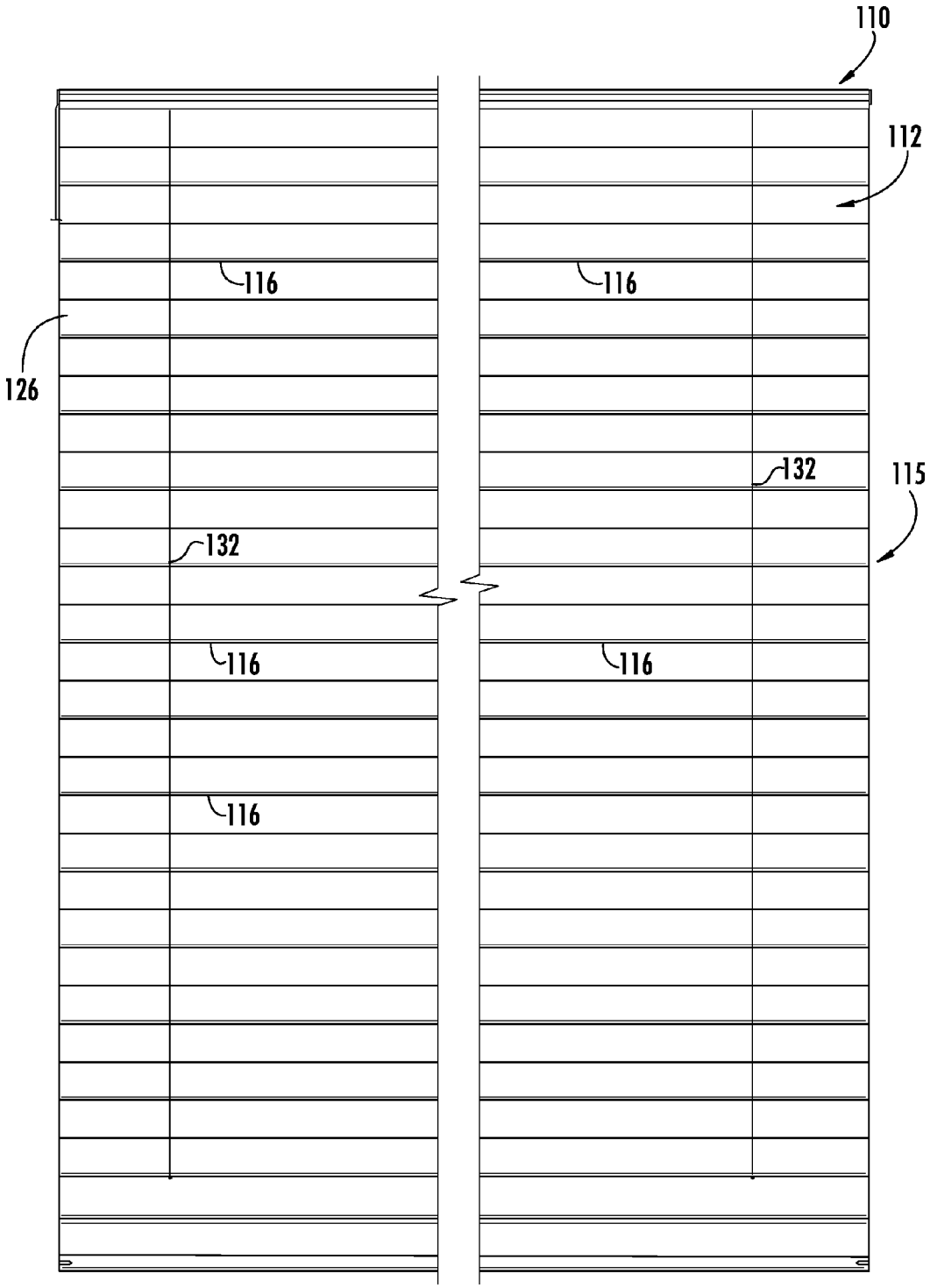
FIG. 7 is a back plan view of the cellular shade assembly illustrated in FIG. 5.

The entire shade assembly 110 is more particularly shown in FIGS. 6 and 7. FIG. 6 illustrates a front 114 of the shade assembly, while FIG. 7 illustrates a back 115 of the shade assembly. As shown, the shade assembly can include a head rail 118 towards the top of the assembly and a ballast member 134 located at the bottom of the assembly. When in the expanded configuration as shown in FIG. 6, the closed cell structures 112 are in a sequential and interconnected relationship, separated by junctures 116.

The shade assembly 110 further includes a lift system 130 that includes a plurality of lift cords 132. As shown in FIG. 7, the lift cords 132 are disposed in a vertical line of action that is rearward of the back faces 126 of the closed cell structures 112. Thus, the lift cords 132 do not extend through the closed cell structures and do not break or penetrate through the closed circumferential wall of the cells. As described above, the number of lift cords 132 can vary depending upon the particular application. In the embodiment illustrated, the shade assembly 110 includes two parallel lift cords 132 located along the back 115 of the shade assembly 110. More particularly, the lift cords 132 are attached to the junctures 116 of the back faces 126 of the closed cell structures 112. As discussed, the junctures 116 are in the form of tabs that extend outwardly generally at the attachments locations formed between each cell and the front a back face of each cell.

The lift cords 132 may engage with the back faces 126 of the individual cell structures 112 by various means. For instance, the lift cords 132 may pass through a hole or grommet in each of the junctures 116.

Figure 9:
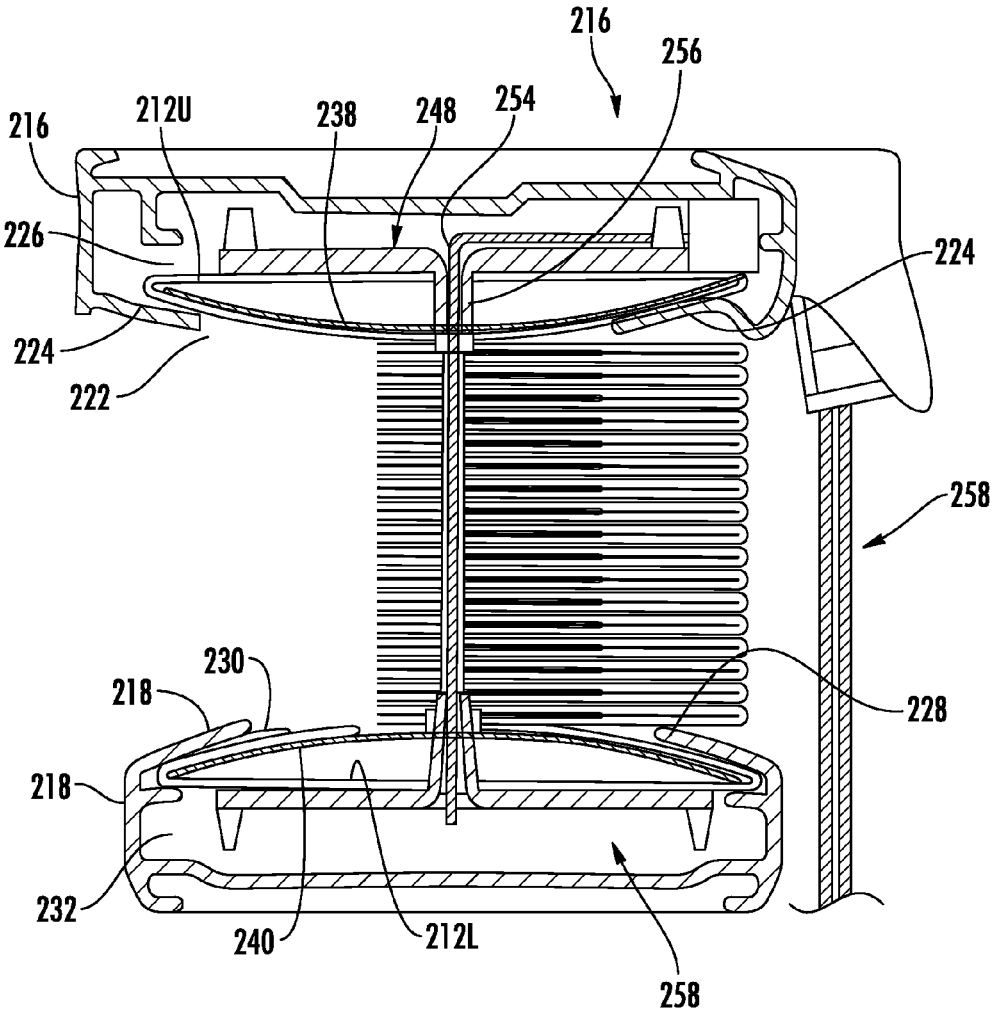
FIG. 9 is a side view of the cellular shade assembly of FIG. 8 in a contracted position.

As shown in FIGS. 8 and 9, the lift cords 232 are actuated by pull cords 258. The pull cords 258 may be extensions of the lift cords 232 and can be presented at a front side of the shade assembly 210 for a user's convenience in operating the shade assembly. It should be readily appreciated that any manner of pulley, bearing, guide, and the like may be incorporated into the head rail assembly for this purpose. For instance, U.S. Pat. No. 7,311,133 to Anderson, et al.; U.S. Pat. No. 7,549,455 to Harper, et al.; and U.S. Pat. No. 7,832,450 to Brace, et al., which are incorporated herein by reference are mentioned as examples of lift systems as may be utilized in conjunction with the disclosed shades, though the disclosure is by no means limited to these exemplary lift systems.

One embodiment of a life system as may be utilized in conjunction with disclosed shades is illustrated in FIGS. 8 and 9. As can be seen, the top rail 216, which could in reality assume numerous different forms, is illustrated as being an extruded channel-shaped member with an elongated channel opening downwardly and defining a gap or opening 222 between inturned longitudinal lips 224 which extend the length of the elongated head rail. A downwardly opening cavity 226 is thereby formed within the headrail for securing the top of the shade assembly 210 and for receiving portions of the lift cord system 214.

As also seen in FIGS. 8 and 9, the bottom rail 218 is similarly illustrated as an elongated extruded member having inturned longitudinal lips 228 extending along the length thereof at the top so as to define an elongated opening 230 through the top. An upwardly opening cavity 232 is thereby defined within the bottom rail in which a portion of the shade assembly 110 and the lift cord system can be anchored.

The shade assembly 210 includes a plurality of closed cell structures 212 that are secured to adjacent cells along top and bottom surfaces thereof as described previously. The cells 212 are transversely collapsible between the expanded position of FIG. 8 and the retracted position of FIG. 9.

In this embodiment, the shade assembly 210 is secured to the top rail 216 by inserting the uppermost cell 212U through the opening 222 in the bottom of the top rail and into the downwardly opening cavity 226 of the top rail and subsequently sliding into the upper cell a rigid or semi-rigid anchor strip 238 of arcuate transverse cross-section, which is wider than the spacing between the lips 224 of the top rail. In this manner, the anchor strip is confined within the cavity of the top rail along with the upper cell 212U of the shade assembly 210. The shade assembly 210 is thereby uniformly suspended from the top rail.

The lowermost cell 212L in the shade assembly 210 is similarly connected to the bottom rail 218 by a second anchor strip 240 which is inserted into the lowermost cell after that cell has been positioned within the upwardly opening cavity 232 of the bottom rail so the anchor strip is confined beneath the lips 228 of the bottom rail 218 thereby securing the lowermost cell 212L of the shade assembly 210 to the bottom rail 218.

Also within the top rail 216 are a pair of slide brackets 248 that are confined within the downwardly opening cavity 226 of the top rail 216 as. The slide brackets 248 have a transverse main body 250 with enlarged rails 252 perpendicular to the main body at opposite ends to support the slide brackets 248 within the top rail 216. Further, a passage 254 and a downwardly extending hollow neck 256 communicating therewith form part of the main body and define a passageway through which portions of the lift cord system can pass.

Similar to the slide brackets 248 in the top rail 216, a pair of cord brackets 258 are incorporated into the bottom rail 218 with each cord bracket 258 being associated and vertically aligned with a slide bracket 248 in the top rail 216. Each cord bracket 258 has a generally rectangular plate-like main body 260 with an upstanding hollow neck 262 defining a passage 264 through the main body for slidable receipt of a component of the lift cord system. Further, the cord bracket 258 has legs 266 at each corner to desirably position the cord bracket 258 within the bottom rail 218.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A cellular shade comprising:

a plurality of sequential and interconnected closed cell structures extending in a longitudinal direction, each cell structure having a collapsed position when the shade is contracted and having an open position when the shade is extended, each cell structure including a front face and a separate back face and defining a top tab and a bottom tab, the back face including a first segment separated from a second segment by a fold line, the front face being attached to the back face at the top tab and the bottom tab, the front face being longer than the back face as measured in the longitudinal direction from the top tab to the bottom tab such that each cell structure has a D-shaped configuration in an open position, the collapsed position of each cell structure including the back face nested within the front face, a first cell structure and a second adjacent cell structure being attached to one another at a juncture that includes the top tab of the first cell structure attached to the bottom tab of the second cell structure with the front face of the first cell structure and the front face of the second cell structure being non-continuous materials attached to one another at the juncture, and the back face of the first cell structure and the back face of the second cell structure also being non-continuous materials; and a lift system configured for vertically drawing said cell structures from an expanded configuration into a contracted configuration;

wherein the material forming the front face is at least two times the weight of the material forming the back thee.

2. The cellular shade according to claim 1, wherein front face includes a first segment separated from a second segment by a fold line.

3. The cellular shade according to claim 1, wherein the front face includes a first segment and a second segment joined to one another at a horizontal tab.

4. The cellular shade according to claim 1, wherein the front face and the back face are both formed of one or more woven materials, a horizontal direction of the cellular shade being in a warp direction of the woven materials.

5. The cellular shade according to claim 1, wherein, when the shade is in a fully contracted configuration, the front face and the back face of the closed cell structures hang in a vertical and adjacently disposed orientation.

6. The cellular shade according to claim 1, wherein the front face is formed of a semi-rigid material, and in the collapsed position each cell structure extends horizontally.

7. The cellular shade according to claim 1, the lift system comprising a plurality of lift cords that are slidably attached to the junctures for placing the shade in the fully contracted configuration.

8. The cellular shade according to claim 1, further comprising a head rail, the lift system being in operative association with the head rail for vertically drawing the closed cell structures from a fully expanded configuration to a fully contracted configuration.

9. The cellular shade according to claim 1, wherein the back face has a transmittance at a wavelength of 500 nanometers that is at least 50% greater than a transmittance of the front face at 500 nanometers.

10. The cellular shade according to claim 1, wherein the material forming the back face has a weight of less than about 3 ounces per square yard.

11. The cellular shade according to claim 1, wherein the material forming the back face has a weight of less than about 1 ounce per square yard.

12. The cellular shade according to claim 1, wherein the cellular shade has a horizontal length of greater than about 110 inches.

13. The cellular shade according to claim 1, wherein the cellular shade has a horizontal length of greater than about 180 inches.

14. The cellular shade according to claim 1, wherein the front face and the back face are each comprised of a fabric material.

* * * * *